US008269123B2

(12) United States Patent
Shin et al.

(10) Patent No.: US 8,269,123 B2
(45) **Date of Patent: *Sep. 18, 2012**

(54) IMAGE DISPLAY DEVICE WITH PLURAL LIGHT EMITTING DIODES

(75) Inventors: Hyeon Jin Shin, Suwon-si (KR); Jae Young Choi, Suwon-si (KR); Dong Kee Yi, Seoul (KR); Seong Jae Choi, Seoul (KR); Seonmi Yoon, Yongin-si (KR)

(73) Assignee: Samsung Electronics Co., Ltd. (KR)

( * ) Notice: Subject to any disclaimer, the term of this patent is extended or adjusted under 35 U.S.C. 154(b) by 0 days.

This patent is subject to a terminal disclaimer.

(21) Appl. No.: 13/190,750

(22) Filed: Jul. 26, 2011

(65) Prior Publication Data

US 2011/0279378 A1 Nov. 17, 2011

Related U.S. Application Data

(62) Division of application No. 11/939,128, filed on Nov. 13, 2007, now Pat. No. 8,026,878.

(30) Foreign Application Priority Data

Jan. 15, 2007 (KR) ..... 10-2007-0004261

(51) Int. Cl.
*H01H 9/18* (2006.01)

(52) U.S. Cl. ..... 200/311; 200/310; 200/313; 200/317; 341/20; 341/22; 341/31; 400/472; 400/486; 400/487

(58) Field of Classification Search ..... 200/308, 200/310, 311, 313, 317; 341/20, 22, 31; 400/472, 486, 487

See application file for complete search history.

(56) References Cited

U.S. PATENT DOCUMENTS

| | | | | |
|---|---|---|---|---|
| 6,356,251 | B1 | 3/2002 | Naito et al. | |
| 6,697,039 | B1 | 2/2004 | Yamakawa et al. | |
| 7,333,072 | B2 | 2/2008 | Yamazaki et al. | |
| 7,446,274 | B2 | 11/2008 | Choi et al. | |
| 8,026,878 | B2 * | 9/2011 | Shin et al. | 345/82 |

* cited by examiner

*Primary Examiner* — My-Chau T Tran
(74) *Attorney, Agent, or Firm* — Cantor Colburn LLP

(57) ABSTRACT

Disclosed herein is an image display device having a plurality of light emitting diodes (LEDs), which can maintain a primary color which is desired to be expressed, and prevent an interference of other unwanted colors and a change of the primary color at the time of application of a light source of each light emitting diode. The image display device comprises: a first optical filter layer containing a violet wavelength-absorbing material having a wavelength range of from 380 nm to 450 nm such as $Bi_2O_3$ so as to prevent light having a wavelength ranging from 380 nm to 450 nm from being leaked out to an undesired region of an image display portion of the image display device; and a second optical filter layer such as a blue color filter layer so as to allow a white light to be expressed in a desired region of the image display portion.

7 Claims, 12 Drawing Sheets

IMAGE DISPLAY DEVICE WITH PLURAL LIGHT EMITTING DIODES

CROSS-REFERENCE TO RELATED APPLICATION

This application is a divisional of U.S. application Ser. No. 11/939,128, filed on Nov. 13, 2007, which claims the benefit under 35 U.S.C. §119(a) of Korean Patent Application No. 10-2007-0004261, filed in the Korean Intellectual Property Office on Jan. 15, 2007, the entire disclosure of which is incorporated herein by reference.

BACKGROUND OF THE INVENTION

1. Field of the Invention

The present invention relates to an image display device, and more particularly to an image display device having a plurality of light emitting diodes (LEDs), which can maintain a primary color which is desired to be expressed and prevent an interference of other unwanted colors, and a change of the primary color at the time of application of a light source of each light emitting diode in the image display device using the plural light emitting diodes.

2. Background of the Related Art

Currently, there has been a constant demand for technological improvement for enhancing system performance in various image display device fields including cellular phones having a digital multimedia broadcasting (DMB) receiving functionality, a PC, WiBro terminals, ultra-high speed data communication devices, telematics terminals, digital versatile discs (DVDs), navigation systems, and the like.

However, such a conventional image display device encounters a problem in that it often does not implement a color which is desired to be expressed. For example, a violet wavelength light is leaked out from a light source of a UV light emitting diode in an image display device employing the UV light emitting diode, or a white light is converted into another colored light, but not expressed normally in an image display device employing a white light emitting diode. In particular, in the case of an image display device employing a plurality of light emitting diodes, a phenomenon may be deepened in which a color which is desired to be expressed is not implemented normally and is converted into another colored light at the time of application of a light source of each light emitting diode due to an effect of different light sources of the light emitting diodes and an interference between materials within an optical filter layer employed for optimization of each light emitting diode.

Therefore, there is a need for a technology which can optimize expression of a desired light and implement stable application of different light emitting diodes upon the application of a light source of each light emitting diode in an image display device employing a plurality of light emitting diodes. In general, generalization of digital media, transmission of a variety of multimedia data, and the development of storage devices and authoring tools enable various multimedia data to be easily to copied and modified through a network, which can provide a new service but resultantly may bring about problems related to copyrights.

SUMMARY OF THE INVENTION

An aspect of exemplary embodiments of the present invention is to provide an image display device having a plurality of light emitting diodes (LEDs), which prevents a violet light having a wavelength ranging from about 380 nm to about 450 nm from being leaked out when light from a UV light emitting diode is emitted, and does not allow a white light to be converted into another colored light when light from a white light emitting diode is emitted.

Another object of exemplary embodiments of the present invention is to provide a key pad assembly for an electronic device, which includes an optical filter layer that emits or does not emit light in a specific optical wavelength range so as to selectively illuminate a character or a numeral depending on a use mode.

Still another object of exemplary embodiments of the present invention is to provide a key pad assembly for an electronic device employing a UV light emitting diode and a white light emitting diode, which prevents a violet light having a wavelength ranging from about 380 nm to about 450 nm from being leaked out when light from a UV light emitting diode is emitted, and does not allow a white light to be converted into another colored light when light from a white light emitting diode is emitted.

According to one aspect of exemplary embodiments of the present invention, there is provided an image display device having a plurality of light emitting diodes (LEDs) including a first light emitting diode and a second light emitting diode, the image display device comprising: a first optical filter layer for preventing light having a wavelength ranging from 380 nm to 450 nm from being leaked out to an undesired region of an image display portion of the image display device; and a second optical filter layer for controlling a white light to be expressed in a desired region of the image display portion.

In the image display device having the plurality of light emitting diodes according to an exemplary embodiment of the present invention, the first light emitting diode may permit light having a tail portion of a wavelength range of from 380 nm to 450 nm to exit from the first light emitting diode, and the second light emitting diode may permit a white light to exit from the second light emitting diode. In addition, the central wavelength of the light exiting from the first light emitting diode may range from, but is not limited to, about 380 nm to 420 nm or 350 nm to 450 nm, and preferably about 400 nm. The width of the wavelength and the position of the central wavelength are determined depending on the kind and quality of a light source used as the first light emitting diode and the second light emitting diode.

In the image display device having the plurality of light emitting diode according to an exemplary embodiment of the present invention, the first optical filter layer may contain inorganic particles which can absorb light having a wavelength range of from 380 nm to 450 nm.

In the present invention, the second optical filter layer may include a layer which permits a white light to be transmitted to the layer to thereby ultimately implement white color in the image display portion, and preferably is a color layer. The second optical filter layer is laminated on the first optical filter layer. For example, the second optical filter layer may comprise a blue color filter layer. Here, the kind of the color filter layer depends upon a light source of the second light emitting diode, and the content of the color filter can be adequately adjusted within a range which can implement the white color while maintaining a balance between various wavelengths of a white light source without being particularly limited. Further, the color filter layer can be made of a material which can achieve the above objects of the present invention regardless of being an organic material or an inorganic material.

In the image display device having the plurality of light emitting diodes according to an exemplary embodiment of the present invention, the inorganic particle may comprise at least one selected from the group consisting of $CO_3O_4$, $ZrO_2$, $Al_2O_3$, $Fe_2O_3$, $Bi_2O_3$, ZnO, $SnO_2$, $In_2O_3$, $Sb_2O_3$, $V_2O_5$, $Cr_2O_3$, CuO, MnO, NiO, $Ce_2O_3$, $B_2O_3$, $Ta_2O_3$, $WO_3$, $TiO_2$ and $Yb_2O_3$.

In the image display device having the plurality of light emitting diodes according to an exemplary embodiment of the present invention, the image display device may further comprise a color-expressing optical filter layer for selectively responding or not responding depending on the size of the wavelength of light exiting from the first and second light emitting diodes and converting the light into various colors. Here, the color-expressing optical filter layer may comprise a fluorescent material that emits light in red (R), green (R) and blue (B) colors, and responds to the light exiting from the first light emitting diode to mix the respective red, green and blue colors with one another so as to express various colors and does not respond to the white light exiting from the second light emitting diode to emit the white light.

In the image display device having the plurality of light emitting diode according to an exemplary embodiment of the present invention, the image display device may comprise a key pad assembly for an electronic device.

According to another aspect of exemplary embodiments of the present invention, there is also provided a key pad assembly for an electronic device which comprises a plurality of light emitting diodes (LEDs) including a first light emitting diode and a second light emitting diode, a light guide plate for permitting light exiting from the plural light emitting diodes to progress along the light guide plate, a plurality of key buttons provided on the top surface of the light guide plate and composed of a numeral input plate and a character input plate, a plurality of reflective patterns provided on the light guide plate for allowing the light to be reflected toward the key buttons, a plurality of protrusions provided on the lower portion of the plurality of reflective patterns, and a switch substrate having a plurality of switches mounted thereon to correspond to the plurality of protrusions, wherein the numeral input plate of the key buttons is provided at the lower portion of the key buttons with a color-expressing optical filter layer for selectively responding or not responding depending on the size of the wavelength of light exiting from the first and second light emitting diodes and converting the light into various colors, and wherein the character input plate of the key button is provided at the lower portion of the key buttons with a first optical filter layer for preventing light having a wavelength ranging from 380 nm to 450 nm from being leaked out, and a second optical filter layer for controlling a white light to be expressed.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENT

Figure 1:
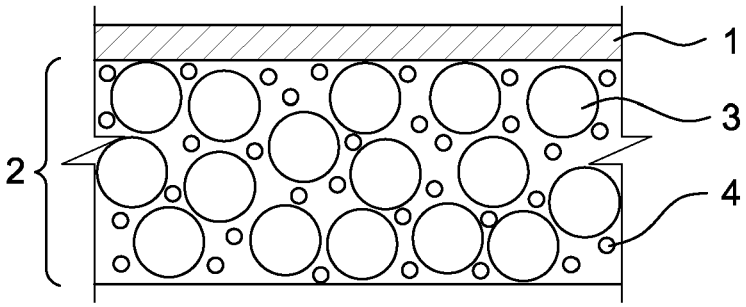
FIG. 1 illustrates an example of a laminated structure of two optical filter layers for explaining an image display device according to an exemplary embodiment of the present invention.

Reference will now be made in detail to exemplary embodiments of the present invention, examples of which are illustrated in the accompanying drawings, wherein like reference numerals refer to the like elements throughout. Exemplary embodiments are described below to explain the present invention by referring to the figures.

FIG. 1 illustrates an example of a laminated structure of two optical filter layers for explaining an image display device according to an exemplary embodiment of the present invention.

As shown in FIG. 1, an image display device according to an exemplary embodiment of the present invention includes a laminated structure consisting of a first optical filter layer 2 and a second optical filter layer 1. The first optical filter layer 2 contains a violet wavelength-absorbing material, for example, $Bi_2O_3$ particles 3 and $TiO_2$ particles 4, absorbing a wavelength range of from 380 nm to 450 nm, narrowly from 400 nm to 450 nm, so as to prevent an undesired violet-wavelength light from being leaked out and decolorization of the white light. Meanwhile, the wavelength of a violet light emitted from a first light emitting diode such as a UV light emitting diode can vary depending on the central wavelength of a light source and the width of the wavelength. Here, the wavelength of the emitted violet light may range broadly from 380 nm to 450 nm, and narrowly from 400 nm to 420 nm.

An embodiment of the present invention may use nano (about 100 nm) particles to increase a particle density within the first optical filter layer to thereby maximize efficiency. Here, the size of the particle is not limited to nano (about 100 nm) size.

In an embodiment of the present invention, the thickness of the first optical filter layer is not particularly limited, and can be suitably controlled depending on the kind, quality and intensity of a light source.

Now, the image display device according to an exemplary embodiment of the present invention is exemplified by, but is not restricted or limited to, a key pad assembly for an electronic device, which will be described hereinafter with reference to FIGS. 2A to 8B.

Figure 2A:
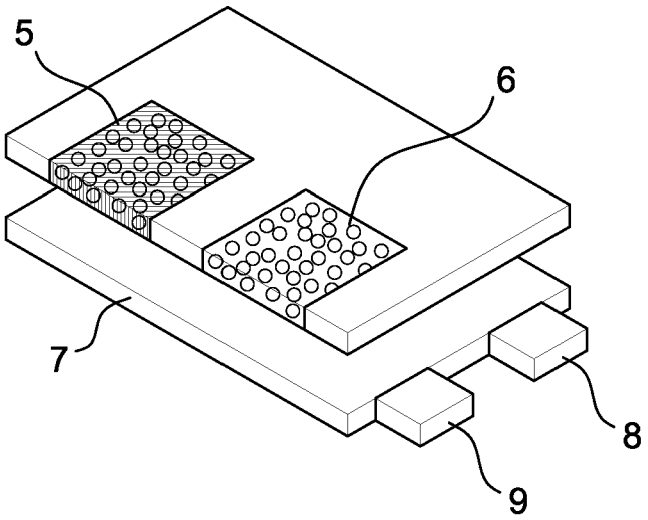
FIGS. 2A through 2C illustrates the configuration of a key pad assembly for explaining an image display device according to an exemplary embodiment of the present invention.
Figure 2B:
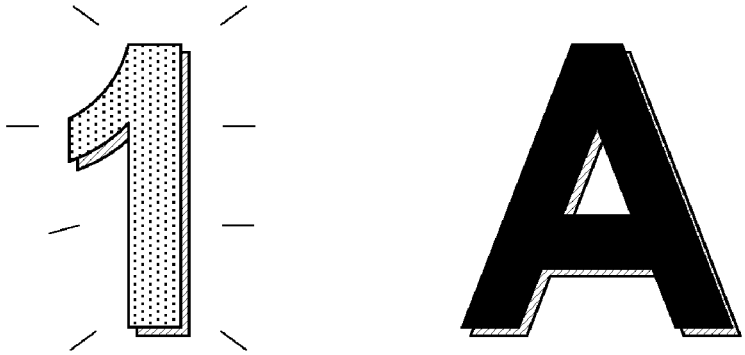
Figure 2C:
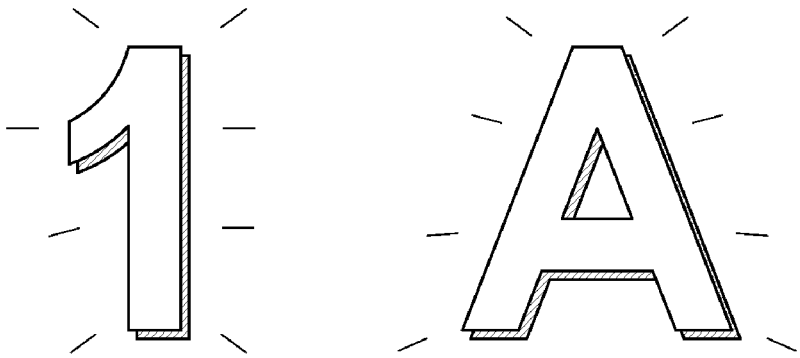

FIGS. 2A through 2C illustrates the configuration of a key pad assembly for explaining an image display device according to an exemplary embodiment of the present invention (a second optical filter layer is not shown).

The Key pad assembly includes a light emitting diode (7). The key pad assembly shown in FIG. 2A employs a violet wavelength-absorbing material, a UV light emitting diode 8 as a first light emitting diode, and a white light emitting diode 9 as a second light emitting diode. A numeral input plate of the key button is formed at the lower portion 5 with a color-expressing optical filter layer having a fluorescent particle (shown in a spherical shape) for selectively responding or not responding depending on the size of the wavelength of light exiting from the first and second light emitting diodes and converting the light into various colors, and a character input plate of the key button is formed at the lower portion 6 with a first optical filter layer having violet wavelength-absorbing material (shown in a spherical shape) of from 380 nm to 450 nm. That is, as shown in FIG. 2B, when light from the UV light emitting diode as the first light emitting diode is emitted, a numeral is illuminated by fluorescent particles of the numeral input plate portion, and as shown in FIG. 2C, when light from the white light emitting diode as the second light emitting diode is emitted, a numeral and a character are illuminated together.

The application principle of the first optical filter layer and the second optical filter layer of the present invention will be sequentially described hereinafter with reference to FIGS. 3A to 8B.

Figure 3A:
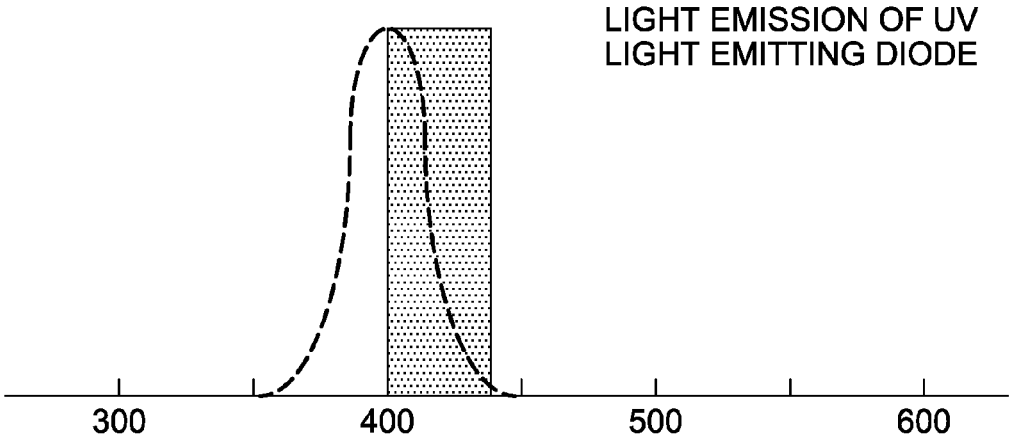
FIG. 3A illustrates a wavelength graph showing the wavelength (central wavelength: 400 nm) of the light at the time of light emission of a UV light emitting diode as a first light emitting diode in a key pad assembly for explaining an image display device according to an exemplary embodiment of the present invention.
Figure 3B:
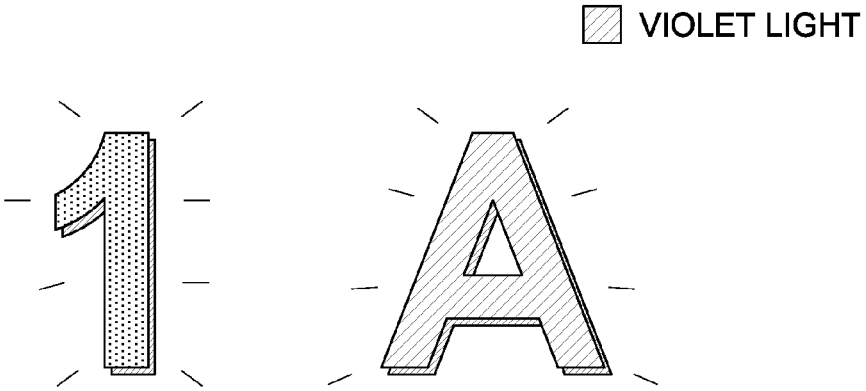
FIG. 3B illustrates a state in which a violet light having a wavelength ranging from 380 nm to 450 nm is leaked out when light from the UV light emitting diode is emitted, according to an exemplary embodiment of the present invention.

As shown in FIGS. 3A and 3B, when light from the first light emitting diode, i.e., the UV light emitting diode is emitted, the light exiting from the light source has a predetermined wavelength range (central wavelength: about 400 nm). In this case, a violet wavelength portion ranging from broadly 380 nm to 450 nm, narrowly from 400 nm to 450 nm is emitted so that a violet light is leaked out to a character portion which is to be transparently displayed.

Figure 4A:
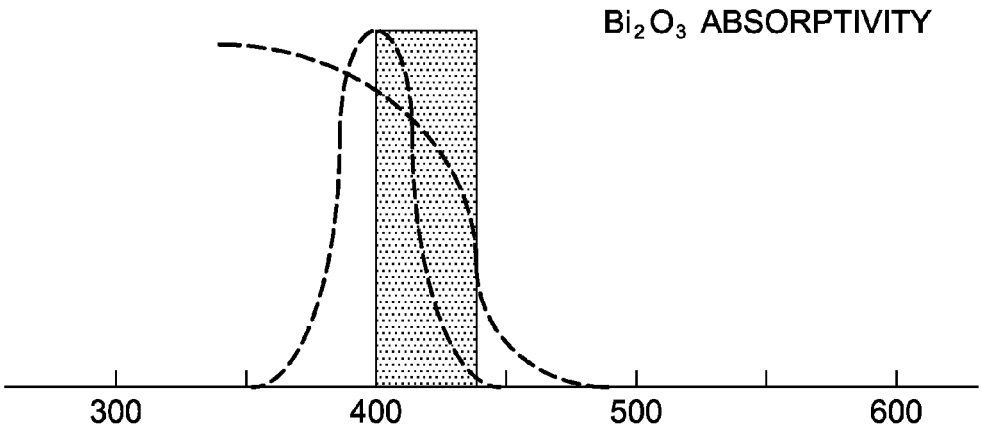
FIG. 4A illustrates a wavelength graph showing a state in which a wavelength of more than 400 nm is absorbed by means of a first optical filter layer containing $Bi_2O_3$ in a key pad assembly for explaining an image display device according to an exemplary embodiment of the present invention.
Figure 4B:
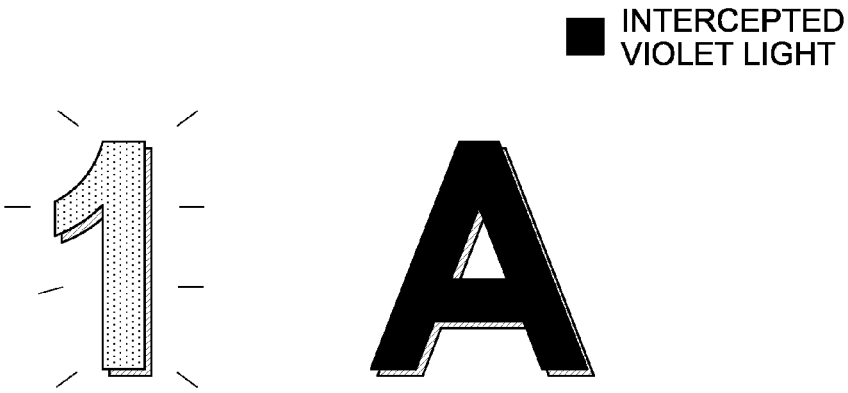
FIG. 4B illustrates a state in which violet light is intercepted due to absorption of the wavelength of more than 400 nm by $Bi_2O_3$, according to an exemplary embodiment of the present invention.

In order to prevent the violet light being leaked, as shown in FIG. 4A, in the case where the first optical filter layer is formed by using a violet wavelength-absorbing material such as $Bi_2O_3$ which can absorb a wavelength ranging broadly from 380 nm to 450 nm, narrowly from 400 nm to 450 nm, a wavelength of more than 400 nm is absorbed by $Bi_2O_3$, and a violet light emitted from the UV light emitting diode (first light emitting diode) is intercepted. As a result, it can be seen from FIG. 4B that the violet light is prevented from being leaked out to the character portion.

Figure 5:
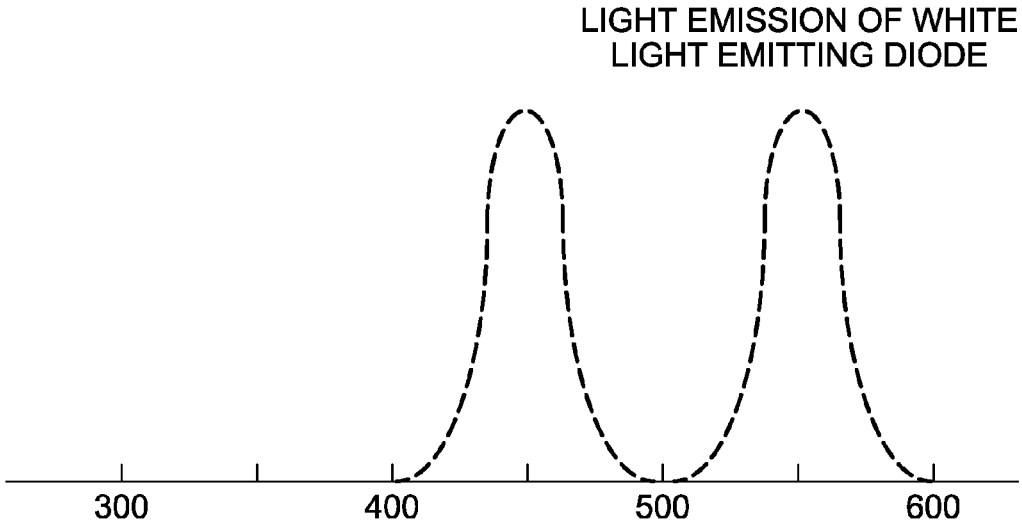
FIG. 5 illustrates a wavelength graph showing a state in which blue-wavelength light and yellow-wavelength light are mixed with each other to express the white light when light from the white light emitting diode as the second light emitting diode is emitted in a key pad assembly for explaining an image display device according to an exemplary embodiment of the present invention.

Also, FIG. 5 illustrates a wavelength graph showing a state in which blue-wavelength light and yellow-wavelength light are mixed with each other to express the white light when light from the white light emitting diode as the second light emitting diode is emitted in the key pad assembly shown in FIG. 2A. That is, when the area ratio between the blue-wavelength light whose central wavelength is about 466 nm and the yellow-wavelength light whose central wavelength is about 551 nm is maintained in a ratio of about 1:1, the white color is implemented.

Figure 6A:
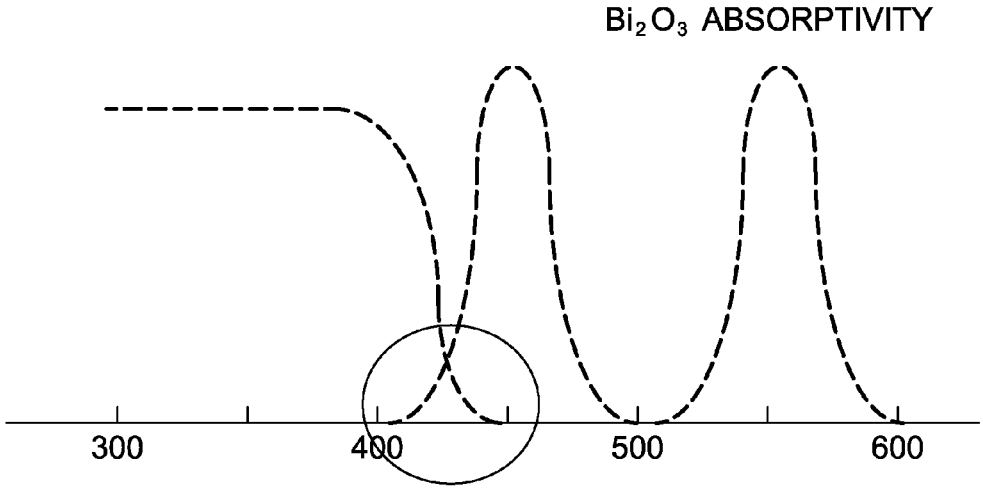
FIG. 6A illustrates a wavelength graph showing a state in which a part of a blue wavelength is absorbed by $Bi_2O_3$ when light from the white light emitting diode (the second light emitting diode) is emitted by means of a first optical filter layer containing $Bi_2O_3$ in a key pad assembly for explaining an image display device according to an exemplary embodiment of the present invention.
Figure 6B:
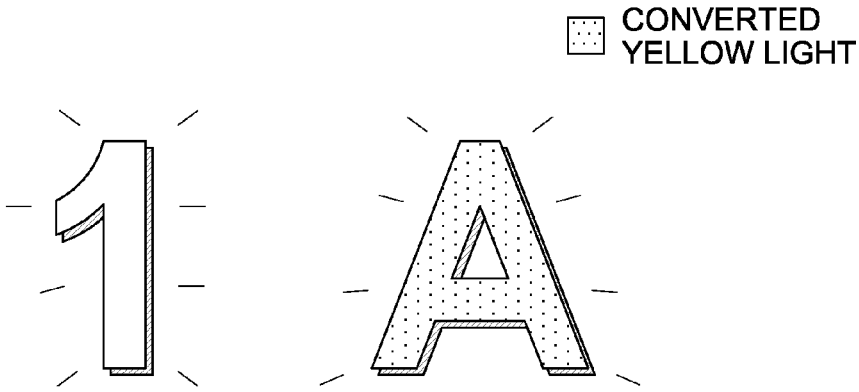
FIG. 6B illustrates a state in which the white light is converted into a yellow light due to absorption of the blue wavelength by $Bi_2O_3$, according to an exemplary embodiment of the present invention.

However, as shown in FIG. 6A, $Bi_2O_3$ of the first optical filter layer absorbs a part of the blue wavelength when light from the white light emitting diode (second light emitting diode) is emitted, and as a result, the area ratio of the blue-wavelength light to the yellow-wavelength light is deviated from the ratio of 1:1. That is, as shown in FIG. 6B, it can be seen that a character portion which is to be expressed into the white color is converted into the light is converted into the yellow color due to absorption of the blue wavelength by $Bi_2O_3$.

Figure 7A:
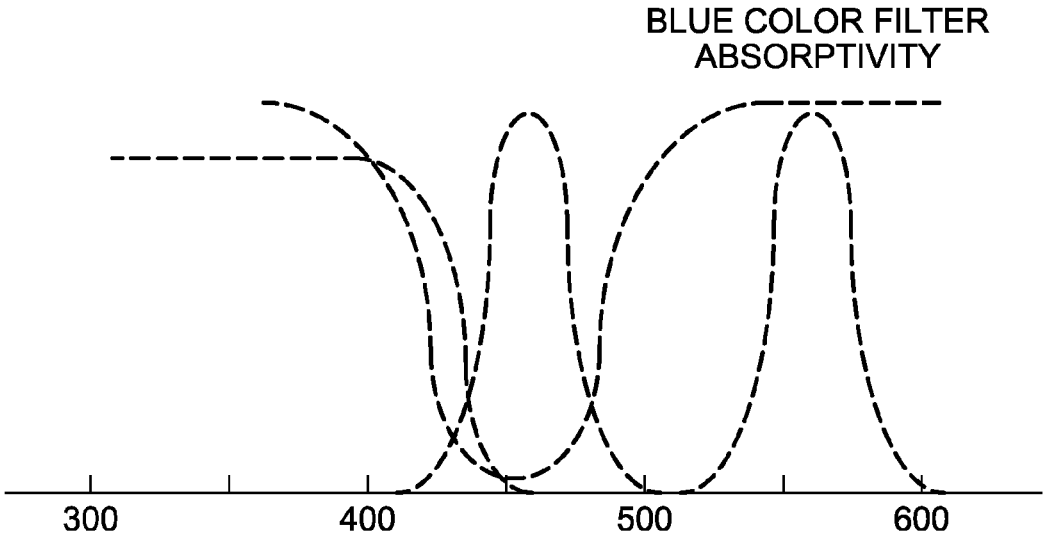
FIG. 7A illustrates a wavelength graph showing a state in which a yellow wavelength is absorbed by a blue color filter layer when light from a white light emitting diode (second light emitting diode) is emitted by the blue color filter layer as a second optical filter layer (the wavelength of the blue color filter is indicated by a "U" shape) in a key pad assembly for explaining an image display device according to an exemplary embodiment of the present invention.
Figure 7B:
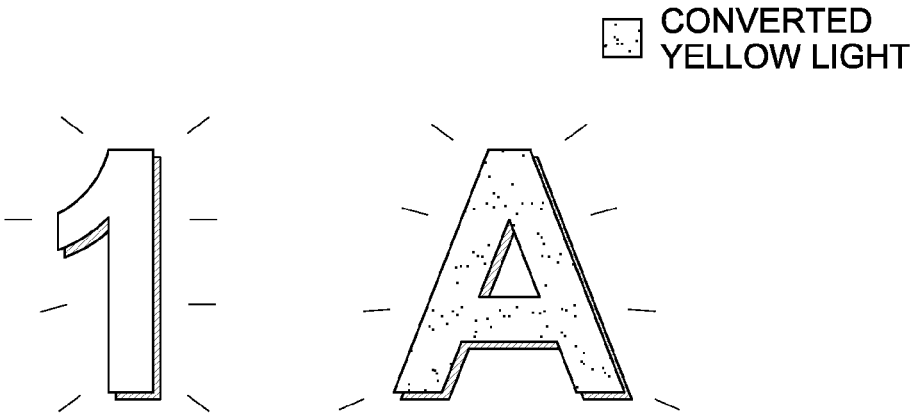
FIG. 7B illustrates a state in which the converted yellow color returns to the white color due to absorption of the yellow wavelength by the blue color filter layer according to an exemplary embodiment of the present invention.

In an embodiment of the present invention, in order to prevent the white light from being decolorized, as shown in FIG. 7A, a blue color filter layer capable of absorbing the yellow wavelength is employed as the second optical filter layer. As a result, as shown in FIG. 7B, it can be seen that a balance between the blue wavelength and the yellow wavelength is maintained due to absorption of the yellow wavelength by the blue color filter layer, and a character portion decolorized into the yellow color returns to the white color.

Figure 8A:
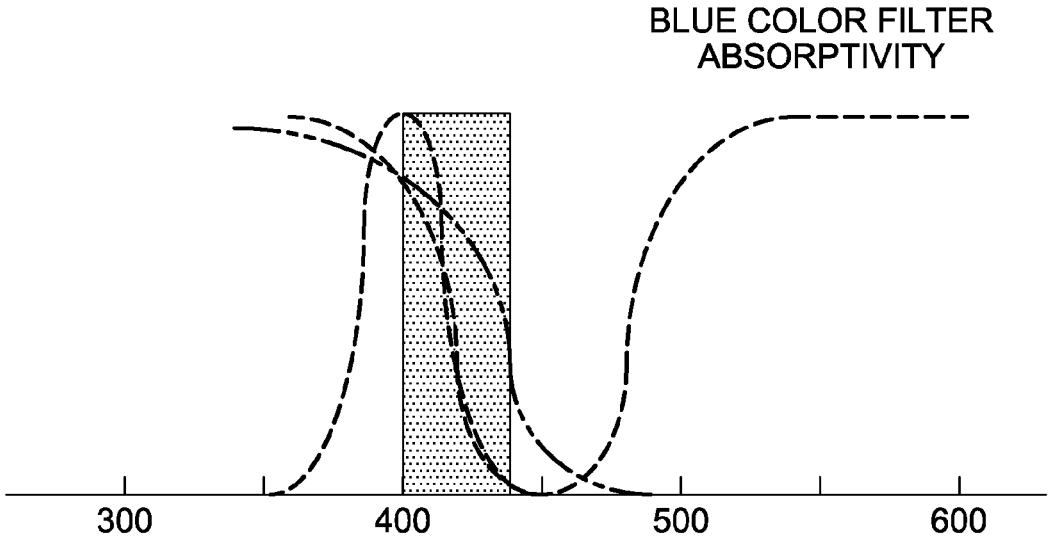
FIGS. 8A and 8B illustrate wavelength graph and view showing a state in which a blue color filter layer as a second optical filter layer does not affect the violet wavelength blocking property of $Bi_2O_3$ when light from a UV light emitting diode (first light emitting diode) is emitted in a key pad assembly for illustrating an image display device according to an exemplary embodiment of the present invention.
Figure 8B:
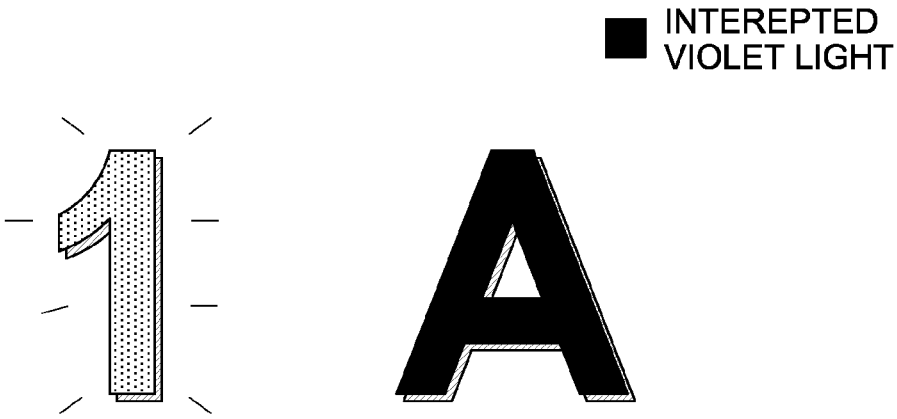

Furthermore, as shown in FIGS. 8A and 8B, the blue color filter layer (second optical filter layer) does not affect the violet wavelength intercepting property of $Bi_2O_3$ when light from the UV light emitting diode (first light emitting diode) is emitted.

Now, the construction and working effect of the present invention will be described hereinafter in more detail with reference to examples. The following examples are intended to describe the contents of the present invention, but is not limited thereto.

Example 1 to 4

Formation of a First Optical Filter Layer Containing $Bi_2O_3$ 8.35 g of $TiO_2$, 33.3 g of $Bi_2O_3$, 10 g of transparent ink, 18 g of cyclohexane, and balls with a diameter of 1 cm and 0.3 mm were mixed with one another by paint shaking for four hours. Thereafter, a $TiO_2/Bi_2O_3$ film was formed as a first optical filter layer using a silk printing method. In the case of the number of $TiO_2/Bi_2O_3$ coatings, the number of coatings was set to "2" in Example 1, the number of coatings was set to "3" in Example 2, the number of coatings was set to "4" in Example 3, and the number of coatings was set to "5 in Example 4.

Experimental Example 1 and Comparative Example 1

Violet Wavelength-Intercepting Effect of the First Optical Filter Layer

In Experiment Example 1, in order to confirm the violet wavelength-intercepting effect of $Bi_2O_3$, the $TiO_2/Bi_2O_3$ film fabricated in Examples 1 to 4 was put on the first light emitting diode, i.e., the UV light emitting diode (central wavelength: 400 nm) and the intensity of light transmitted at the time of light emission from the UV light emitting diode was measured (Experimental Examples 1-a to 1-d). Here, the intensity of the light was measured by using Ocean Optics USB 100 detector. A result of the measurement was shown in Table 1 below and FIG. 9. In the following measurement result, in a state where the $TiO_2/Bi_2O_3$ film is not put on the UV light emitting diode, the intensity of light measured at the time of light emission from the UV light emitting diode is shown in Comparative Experimental Example 1. In the following measurement result, as a result obtained by observing a light-leaking phenomenon through naked eyes, the case where the light-leaking phenomenon does not occur was indicated by "X", the case where the light-leaking phenomenon occur slightly was indicated by "Δ", the case where the light-leaking phenomenon occur moderately was indicated by "O", and the case where the light-leaking phenomenon occur considerably was indicated by "◎", respectively.

TABLE 1

| Experiment No. | Sample No./ Coating number | Film thickness | 400 nm Intensity | Light leakage phenomenon |
|---|---|---|---|---|
| Comparative Experimental Example 1 | — | — | 3500 | — |
| Experimental Example 1-a | Example 1/two times | 15 um | 5.4 | ◎ |
| Experimental Example 1-b | Example 2/three times | 23 um | 5.0 | ○ |
| Experimental Example 1-c | Example 3/four times | 35 um | 4.6 | Δ |
| Experimental Example 1-d | Example 4/five times | 40 um | 3.0 | X |

Figure 9:
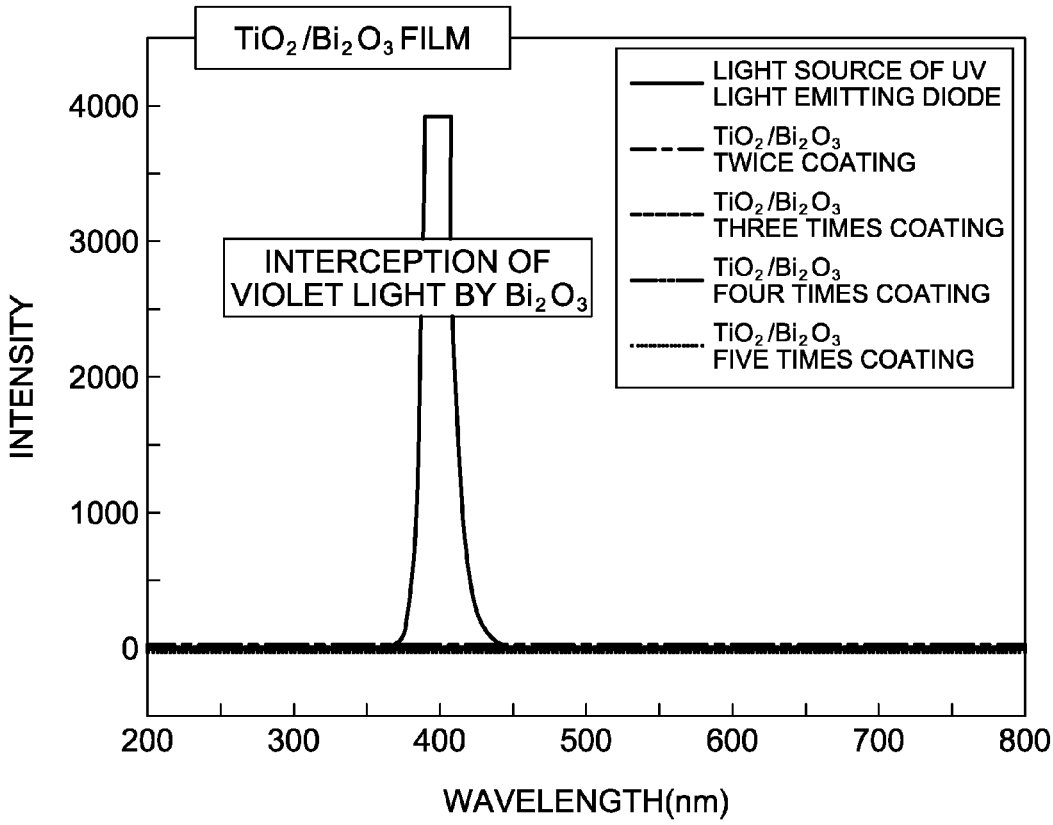
FIG. 9 illustrates a wavelength-strength measurement spectrum showing a state in which a violet light is intercepted by a first optical filter layer containing $Bi_2O_3$ when light from a UV light emitting diode (first light emitting diode) is emitted in the image display device according to an exemplary embodiment of the present invention.

As can be seen from the above Table 1 and FIG. 9, in the case of using the first optical filter layer containing $Bi_2O_3$, light with a wavelength range of from 400 nm to 420 nm is absorbed and intercepted, and as a result, a violet wavelength light is prevented from being leaked out.

Experimental Example 2 and Comparative Experimental Example 2

Confirmation of Change of the Blue and Yellow Wavelengths at the Time of Light Emission from the White Light Emitting Diode In Experiment Example 2, in order to confirm the violet wavelength-intercepting effect of $Bi_2O_3$, the $TiO_2/Bi_2O_3$ film layer (first optical filter layer) fabricated in Examples 1 to 4 is put on the second light emitting diode, i.e., the white light emitting diode (central wavelength: 400 nm) and the intensity of blue and yellow lights transmitted at the time of light emission from the white light emitting diode was measured (Experimental Examples 2-a to 2-d). Here, the intensity of the light was measured by using Ocean Optics USB 100 detector. A result of the measurement is shown in Table 2 below and FIG. 10. In the following measurement result, in a state where the $TiO_2/Bi_2O_3$ film is not put on the white light emitting diode, the intensity of blue and yellow lights measured at the time of light emission from the white light emitting diode is shown in Comparative Experimental Example 2. Also, in the following measurement result, the ratio of the blue light to the yellow light indicates the peak height ratio between respective wavelengths of the blue and yellow lights.

TABLE 2

| Experiment No. | Sample No./ Coating number | Blue color (466 nm) wavelength intensity | Yellow color (551 nm) wavelength intensity | blue/yellow ratio (peak height) |
|---|---|---|---|---|
| Comparative Experimental Example 2 | — | 1056.59 | 526.59 | 2.01 |
| Experimental Example 2-a | Example 1/ two times | 134.02 | 101.02 | 1.33 |
| Experimental Example 2-b | Example 2/ three times | 104.01 | 73.01 | 1.42 |
| Experimental Example 2-c | Example 3/ four times | 82.23 | 77.23 | 1.06 |
| Experimental Example 2-d | Example 4/ five times | 47.47 | 48.47 | 0.98 |

Figure 10:
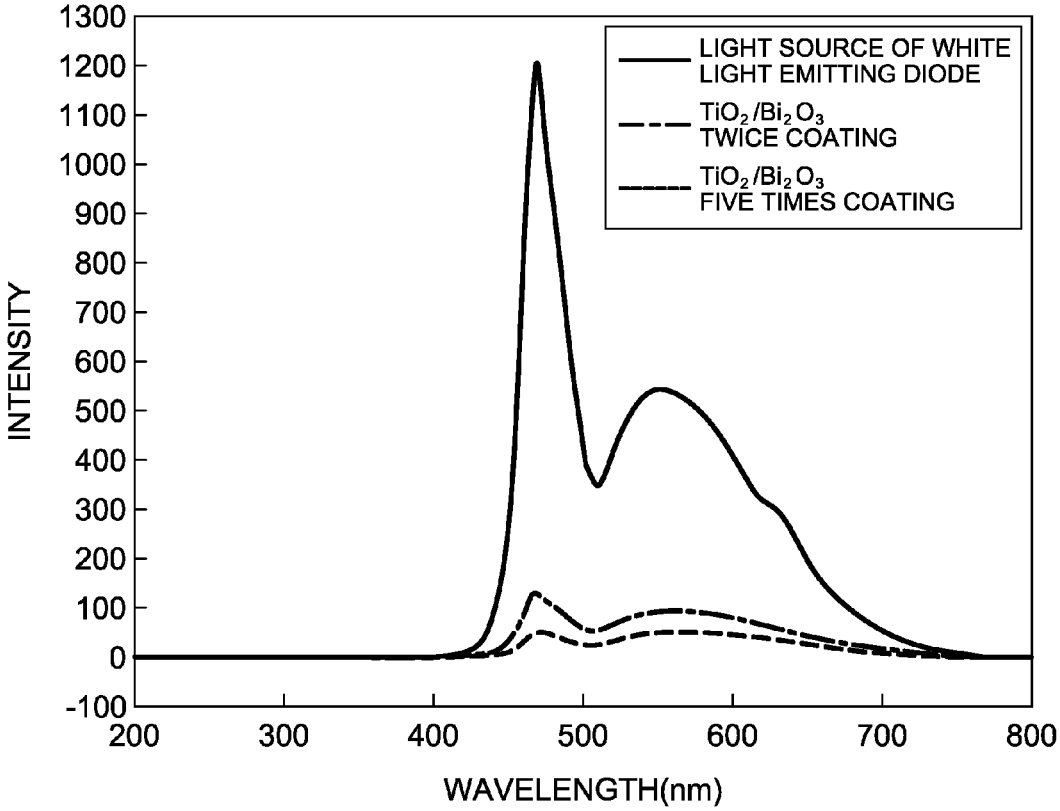
FIG. 10 illustrates a wavelength-strength measurement spectrum showing a state in which a ratio of a blue wavelength to a yellow wavelength varies by a first optical filter layer containing $Bi_2O_3$ when light from a white light emitting diode (second light emitting diode) is emitted in the image display device according to an exemplary embodiment of the present invention.

As can be seen from the above Table 2 and FIG. 10, in the case of using the first optical filter layer containing $Bi_2O_3$, the blue wavelength is absorbed, and as a result, the ratio of the blue light to the yellow light is gradually decreased. When the ratio of the blue light to the yellow light is deviated from a certain level, the white color is converted into the yellow color in the image display device at the time of light emission from the white light emitting diode.

Examples 5 to 7

Lamination of the Second Optical Filter Layer

In Examples 5 to 7, the blue color filter layer as the second optical filter layer is coated in different concentrations on the $TiO_2/Bi_2O_3$ film (the number of coatings; 5) as the first optical filter layer fabricated in Example 4 to thereby fabricate a complex optical filter layer. Here, the blue color filter layer was fabricated such that a blue color filter (Inorganic=$CoAl_2O_3$) contained in an amount of 20 wt % in a solvent prophylene glycol monomethyl ether acetate (PGMEA) was added to 12.5 g of transparent ink so that the content (wt %) of the blue color filter becomes 1.5 wt % (Example 5), 2.0 wt % (Example 6) and 9.0 wt % (Example 7), respectively, and then, the mixture was distributed with tinky.

Experimental Example 3

White Color Implementing Effect of the Second Optical Filter Layer

In Experimental Example 3, in order to confirm white color implementing effect of the second optical filter layer, a complex light filter layer composed of the $TiO_2/Bi_2O_3$ film layer (first optical filter layer) and the blue color filter layer fabricated in Examples 5 to 7 was put on the second light emitting diode, i.e., the white light emitting diode, and the intensity of the blue and yellow lights transmitted at the time of light emission from the white light emitting diode was measured (Experimental Examples 3-a to 3-c). Here, the intensity of the light was measured by using Ocean Optics USB 100 detector. A result of the measurement is shown in Table 3 below and FIG. 11.

TABLE 3

| Experiment No. | Sample No./ | Color filter wt % ($TiO_2$/ $Bi_2O_3$ coatings Five times) | Blue (466 nm) wave-length intensity | Yellow (551 nm) wave-length intensity | Blue/ Yellow ratio (peak height) |
|---|---|---|---|---|---|
| Experimental Example 2-d | Example 4 | 0 | 47.47 | 48.47 | 0.98 |
| Experimental Example 3-a | Example 5 | 1.5 | 44.15 | 34.15 | 1.29 |
| Experimental Example 3-b | Example 6 | 2.0 | 40.53 | 30.53 | 1.33 |
| Experimental Example 3-c | Example 7 | 9.0 | 34.38 | 26.38 | 1.30 |

Figure 11:
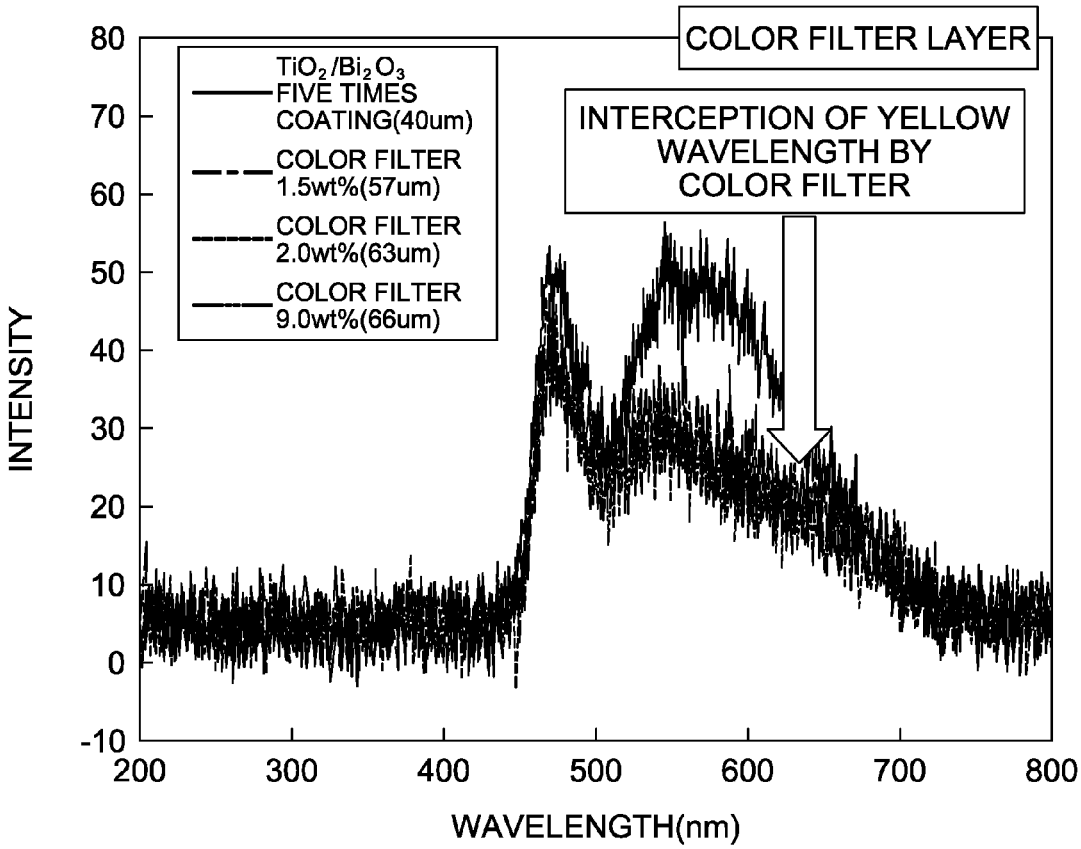
FIG. 11 illustrates a wavelength-strength measurement spectrum showing a state in which a ratio of a blue wavelength to a yellow wavelength is adjusted by a blue color filter layer (second optical filter layer) when light from a white light emitting diode (second light emitting diode) is emitted in the image display device according to an exemplary embodiment of the present invention.

As can be seen from the above Table 3 and FIG. 11, the yellow wavelength is absorbed by the blue color filter layer (second optical filter layer) at the time of light emission from the white light emitting diode (second light emitting diode), and as a result, the ratio of the blue light to the yellow light in increased. In this manner, when the ratio of the blue light to the yellow light is recovered to a certain level to maintain a balance between the blue wavelength and the yellow wavelength, the decolorized yellow color in the image display portion returns to the white color at the time of light emission from the white light emitting diode. Typically, in the case where the area ratio of the blue wavelength to the yellow wavelength is 1:1, the white color is implemented. In this case, when a peak height ratio of the blue wavelength to the yellow wavelength is about 1.3, it can be determined that the white color seems to appear when being observed with naked eyes and abnormality does not occur.

Experimental Example 4

Influence of the Second Optical Filter Layer on the Violet Wavelength-Intercepting Effect In Experimental Example 4, in order to confirm the influence of the blue color filter layer as the second optical filter layer on the violet wavelength-intercepting effect at the time of light emission from the UV light emitting diode (first light emitting diode), a complex light filter layer composed of the $TiO_2/Bi_2O_3$ film layer (first optical filter layer) and the blue color filter layer (second optical filter layer) fabricated in Examples 5 to 7 was put on the UV light emitting diode, and the intensity of the light transmitted at the time of light emission from the UV light emitting diode was measured (Experimental Examples 4-a to 4-c). Here, the intensity of the light was measured by using Ocean Optics USB 100 detector. A result of the measurement is shown in FIG. 12.

Figure 12:
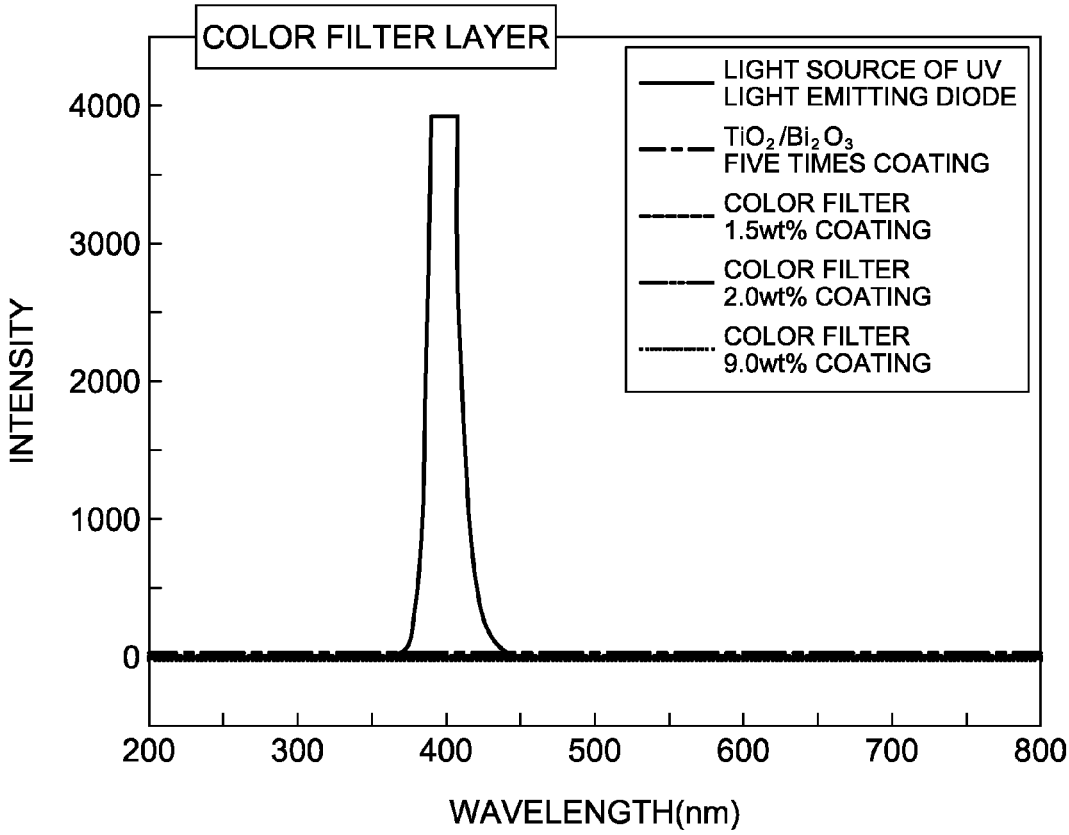
FIG. 12 illustrates a wavelength-strength measurement spectrum showing a state in which a blue color filter layer as a second optical filter layer does not affect the violet wavelength intercepting property of $Bi_2O_3$ when light from a UV light emitting diode (first light emitting diode) is emitted in the image display device according to an exemplary embodiment of the present invention.

As shown in FIG. 12, it can be seen that the violet wavelength-intercepting effect of the first light filter layer containing $Bi_2O_3$ is maintained regardless of whether the second optical filter layer, i.e., the blue color filter layer exists. That is, the blue color filter layer does not affect the violet wavelength-intercepting effect of $Bi_2O_3$.

As described above, the image display device having a plurality of light emitting diodes according to an exemplary embodiment of the present invention employs the first optical filter layer containing a violet wavelength-absorbing material such as $Bi_2O_3$ so as to prevent violet light from being leaked out to an undesired region of an image display portion of the image display device when light from the first light emitting diode, i.e., the UV light emitting diode is emitted, and employs the blue color filter layer as the second optical filter layer so as to allow the ratio of a blue wavelength to a yellow wavelength to vary due to interference between different materials within the image display device when light from the second light emitting diode, i.e., the white light emitting diode is emitted, to thereby prevent the color of a specific region of the image display portion which is to be originally expressed into the white color from being converted into other color.

In addition, in the image display device having a plurality of light emitting diodes according to an exemplary embodiment of the present invention, the blue color filter layer as the second optical filter layer does not affect the violet wavelength intercepting property of the first optical filter layer.

Moreover, the present invention permits a numeral and a character to selectively be illuminated through the use of the UV light emitting diode as the first light emitting diode and the white light emitting diode as the second light emitting diode, and provides a key pad assembly for an electronic device which is excellent in terms of the violet wavelength-intercepting effect and the white light-maintaining effect.

While the present invention has been described with reference to the particular illustrative exemplary embodiments, it is not to be restricted by the exemplary embodiments but only by the appended claims. It is to be appreciated that those skilled in the art can change or modify the embodiments without departing from the scope and spirit of the present invention.

What is claimed is:

1. A key pad assembly for an electronic device comprising a plurality of light emitting diodes (LEDs) including a first light emitting diode and a second light emitting diode, a light guide plate for permitting light exiting from the plural light emitting diodes to progress along the light guide plate, a plurality of key buttons provided on the top surface of the light guide plate and composed of a numeral input plate and a character input plate, a plurality of reflective patterns provided on the light guide plate for allowing the light to be reflected toward the key buttons, a plurality of protrusions provided on the lower portion of the plurality of reflective patterns, and a switch substrate having a plurality of switches mounted thereon to correspond to the plurality of protrusions, wherein the numeral input plate of the key buttons is provided at the lower portion of the key button with a color-expressing optical filter layer for selectively responding or not responding depending on the size of the wavelength of light exiting from the first and second light emitting diodes and converting the light into various colors, and wherein the character input plate of the key button is provided at the lower portion of the key button with a first optical filter layer for preventing light having a wavelength ranging from 380 nm to 450 nm from being leaked out, and a second optical filter layer for controlling a white light to be expressed.

2. The key pad assembly for the electronic device of claim 1, wherein the first light emitting diode permits light having a tail portion of a wavelength range of from 380 nm to 450 nm to exit from the first light emitting diode, and the second light emitting diode permits a white light to exit from the second light emitting diode.

3. The key pad assembly for the electronic device of claim 1, wherein the first optical filter layer contains an inorganic particle which can absorb light having a wavelength range of from 380 nm to 450 nm.

4. The key pad assembly for the electronic device of any one of claims 1, wherein the second optical filter layer is a color layer and is laminated on the first optical filter layer.

5. The key pad assembly for the electronic device of claim 4, wherein the second optical filter layer is a blue color filter layer when a light source of the second light emitting diode mixes blue light whose central wavelength is 466 nm and yellow light whose central wavelength is 551 nm to emit the white light.

6. The key pad assembly for an electronic device of any one of claims 1, wherein the inorganic particle comprises at least one selected from the group consisting of $Co_3O_4$, $ZrO_2$, $Al_2O_3$, $Fe_2O_3$, $Bi_2O_3$, ZnO, $SnO_2$, $In_2O_3$, $Sb_2O_3$, $V_2O_5$, $Cr_2O_3$, CuO, MnO, NiO, $Ce_2O_3$, $B_2O_3$, $Ta_2O_3$, $WO_3$, $TiO_2$, and $Yb_2O_3$.

7. The key pad assembly for an electronic device of claim 1, wherein the color-expressing optical filter layer comprises a fluorescent material that emits light in red (R), green (R) and blue (B) colors, and wherein the color-expressing optical filter layer responds to the light exiting from the first light emitting diode to mix the respective red, green and blue colors with one another so as to express various colors, and does not respond to the white light exiting from the second light emitting diode to emit the white light.

* * * * *